US005090347A

United States Patent [19]

Radi

[11] Patent Number: 5,090,347

[45] Date of Patent: Feb. 25, 1992

[54] VARIABLE SPEED TROLLING APPARATUS

[76] Inventor: Gabor L. Radi, 325 - 21st St. NE., Jamestown, N. Dak. 58401

[21] Appl. No.: 496,214

[22] Filed: Mar. 20, 1990

[51] Int. Cl.[5] ..... B63H 25/44

[52] U.S. Cl. ..... 114/145 R

[58] Field of Search ..... 114/145 R, 145 A; 440/66, 67, 38, 40, 47; 416/179; 239/265, 265.19, 265.29, 265.43

[56] References Cited

U.S. PATENT DOCUMENTS

| | | | |
|---|---|---|---|
| 1,475,695 | 11/1923 | Golden | 114/145 R |
| 2,155,112 | 4/1939 | Anderson . | |
| 2,509,238 | 5/1950 | Martin . | |
| 2,548,121 | 4/1951 | Reid . | |
| 2,916,005 | 12/1959 | Parsons . | |
| 3,214,903 | 11/1965 | Cochran | 440/47 |
| 3,823,684 | 7/1974 | Baggs . | |
| 3,965,839 | 6/1976 | Lenz | 114/145 A |
| 4,026,231 | 5/1977 | Fedorko | 114/145 A |
| 4,549,498 | 10/1985 | Meyer et al. | 114/145 A |

*Primary Examiner*—Jesûs D. Sotelo

*Attorney, Agent, or Firm*—Merchant, Gould, Smith, Edell, Welter & Schmidt

[57] ABSTRACT

The method and apparatus for entraining the thrust from a propeller and directing the thrust aft in a regulated manner so as to provide directional stability and speed for an aquatic vessel. The invention includes an entrainment member 12 which hinges between an operative and inoperative position utilizing retractor assembly 54. Entrainment member 12 includes a regulator assembly 28 which further includes a screw assembly 22 driven by a motor 32. The entrainment member 12 is generally frusto-conical in shape. Located within entrainment member 12 is cone member 128 which is mounted with the point facing forward and the base aft. Cone member 128 includes a nut 30 which cooperatively engages screw assembly 22. Therefore, when screw assembly 22 turns, cone member 128 moves forward and aft within entrainment member 12. Movement of the cone member 128 increases and decreases the flow or water from a propeller through the entrainment member 12 thereby affecting vessel speed.

20 Claims, 9 Drawing Sheets

VARIABLE SPEED TROLLING APPARATUS

FIELD OF THE INVENTION

The present invention relates generally to an apparatus for controlling the speed of a watercraft, and more particularly, to an apparatus for controlling the thrust from an outboard or inboard motor for purposes of trolling.

BACKGROUND OF THE INVENTION

Fishermen have long been hampered by the unavailability of an effective device for varying the speed of an inboard or outboard motor to allow for trolling. The need has been particularly acute for those anglers whose large horsepower motors do not allow them to reduce speeds for proper presentation of bait. Motors greater than about 25 horsepower do not have the capability to operate at low trolling speeds necessary to achieve proper presentation of bait.

Typically, users have resorted to a separate motor for trolling. However, use of an additional motor is cumbersome and requires additional boat space. The additional motor must be fueled by gasoline or electricity and therefore, space must be provided to accommodate the additional equipment. Additional equipment also increases the weight of the boat as a whole. Increased weight may also reduce the maximum speed of the boat. Further, the user must switch from motor to motor depending on the desired speed. Therefore, this switching increases work for the angler and decreases fishing time.

Alternatively, users have employed devices which reduce the effective speed of the user's present motor. A number of such devices have been developed which are directed to the reduction of speed of an inboard or outboard motor. However, the devices are not practical for today's high performance boats and motors and reduce user control of the craft. A number of these devices utilize plates located aft of the motor propeller to disrupt the flow of the propeller thrust. The speed of the boat is thereby reduced, but at the expense of the boat control. The boat control is affected since the thrust is often times deflected down and forward thereby disrupting the flow from the path originally intended. Also, forcing the water jets down results in unnecessary disruption of the water which scares or spooks the fish beneath the craft. Another problem with some prior art devices is that they are generally fixed in position aft of the motor's propeller and create a significant drag when the speed control device is not being utilized. Therefore, the user is not able to utilize the full capabilities of the equipment. The device becomes a hindrance when the boat operates at higher speeds.

Also, a number of the prior art devices allow only one trolling speed. The trolling speed necessary to position the boat as desired changes constantly. Weather conditions and the desired type of fishing play a large role in the speed necessary for proper presentation of bait. It is necessary for the fishermen to be able to choose the proper trolling speed for current conditions and the desired type of fishing.

The present invention offers an improved trolling apparatus that fills a need in the art for a simple, effective, easy to use apparatus which is not limited by the problems associated with prior art devices.

SUMMARY OF THE INVENTION

The invention provides an apparatus for controlling the speed of a boat. In a preferred embodiment constructed according to the principles of the present invention, the apparatus is operatively connected to an inboard or outboard motor and is placed in the water aft of the propeller, wherein the thrust of the motor is directed into the apparatus, and the rate of flow through the apparatus is controlled by the position of a moveable member therein. As higher or lower speed is desired, an operator engages a stepper motor to move the member within the device which controls the rate of flow exiting the device (i.e., the rearward thrust is controlled). Movement of the member greatens or lessens the opening through which fluid may flow. The greater the space or opening, the greater the speed of the boat. Therefore, proper boat speed is achieved for a given propeller thrust. In this manner, it is possible for the user to adjust for external factors such as wind or water currents where it has not heretofore been possible.

The present invention includes an apparatus for controlling a thrust of the type created by a propeller of an aquatic motor, comprising means for entraining the thrust connected to the motor; means for regulating the thrust flow through said entrainment means, said regulating means connected to said entrainment means, wherein said regulating means is moved forward or aft within said entrainment means to regulate the fluid flow rate therein.

Another feature of the present invention is that it does not deflect water in a manner which disrupts the aquatic life beneath the boat. Instead, the flow is deflected uniformly from around the device. The present invention may also include means for retraction so that the full potential of the outboard or inboard motor may be utilized according to the conditions and desires of the user.

While the present invention will be described with respect to a preferred configuration of the apparatus, and with respect to preferred materials and shapes of construction, it will be understood that other configurations, materials, and shapes could be used for constructing the apparatus, without departing from the spirit and scope of this invention. Various advantages and features of novelty which characterize the invention are pointed out with particularity in the claims annexed hereto and which form a part hereof. However, for a better understanding of the invention and the advantages obtained by its use, reference should be made to the drawing which forms a further part hereof and to the accompanying descriptive matter in which there is illustrated and described a preferred embodiment of the invention.

BRIEF DESCRIPTION OF THE DRAWING

In the drawing, wherein like numerals represent like parts throughout the several views.

DETAILED DESCRIPTION OF THE PREFERRED EMBODIMENT

Figure 1:
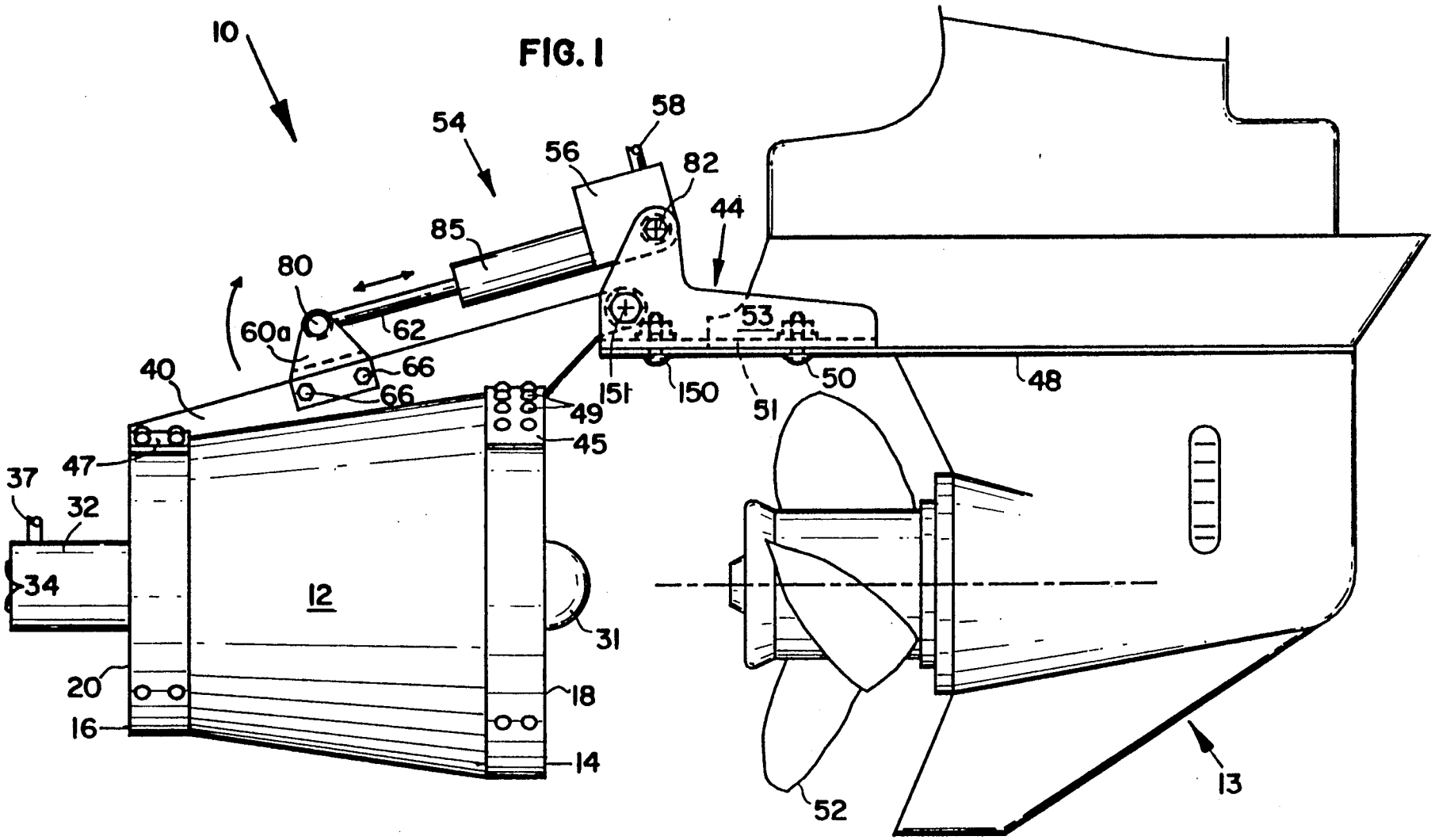
FIG. 1 is a side elevational view of the apparatus shown in operating position connected to a boat motor.

Referring first to FIG. 1, there is generally disclosed at 10, a preferred variable speed trolling apparatus constructed according to the principles of the present invention. The apparatus 10 includes a housing or entrainment member 12 having first and second ends 14 and 16 respectively. Forward opening 18 and aft opening 20 correspond to first and second ends 14 and 16 respectively. In the preferred embodiment, the housing 12 is generally frusto-conical in shape and made of composites such as cavalar/epoxy or graphite. Aluminum may also be utilized, as well as any other suitable material. As will be appreciated by those skilled in the art, the design considerations for the housing 12 include its resistance to corrosion in the water as well as weight considerations. The housing 12, therefore, forms a hollow cylinder which tapers toward the aft end. As will be more fully described hereafter, the thrust from an inboard or outboard motor 13 enters the housing 12 through forward opening 18 and exits aft opening 20.

Figure 4:
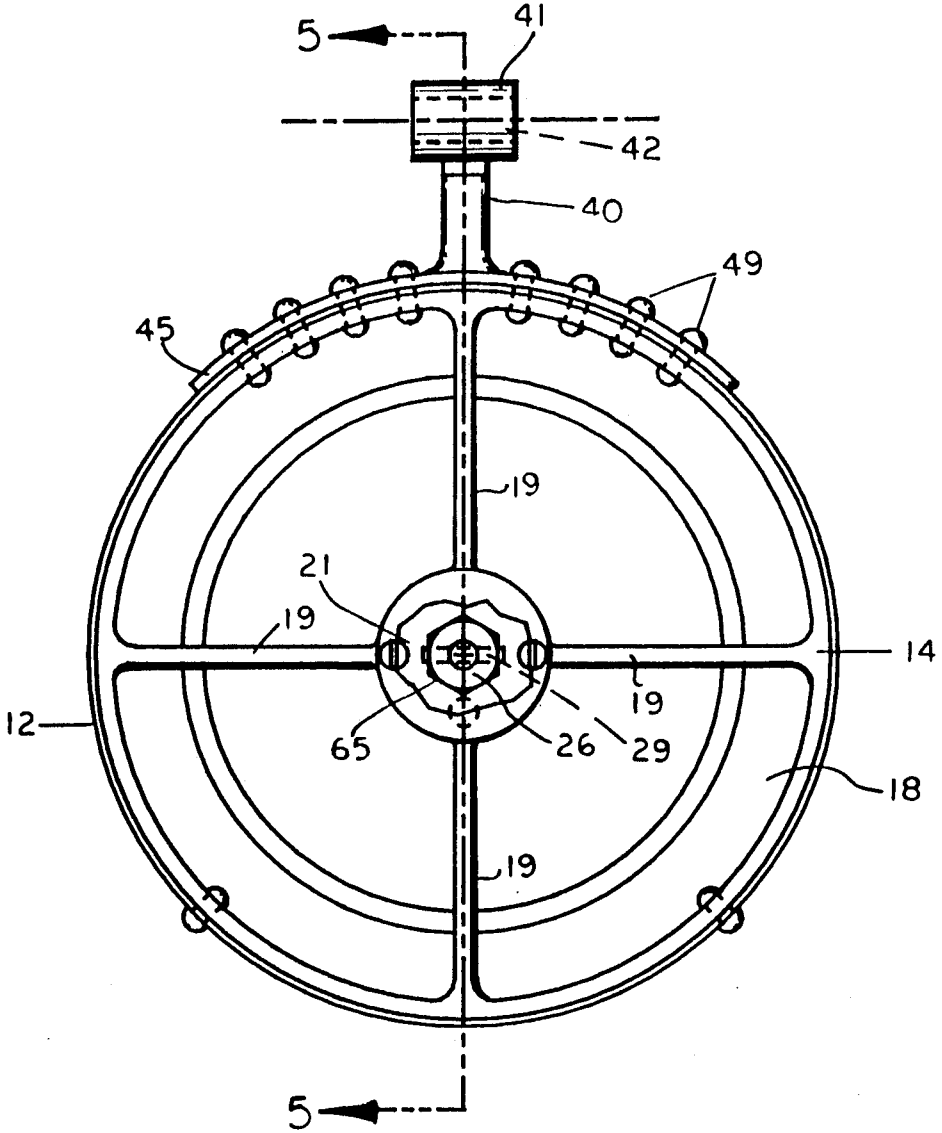
FIG. 4 is a partial front view of the apparatus of FIG. 1.
Figure 5:
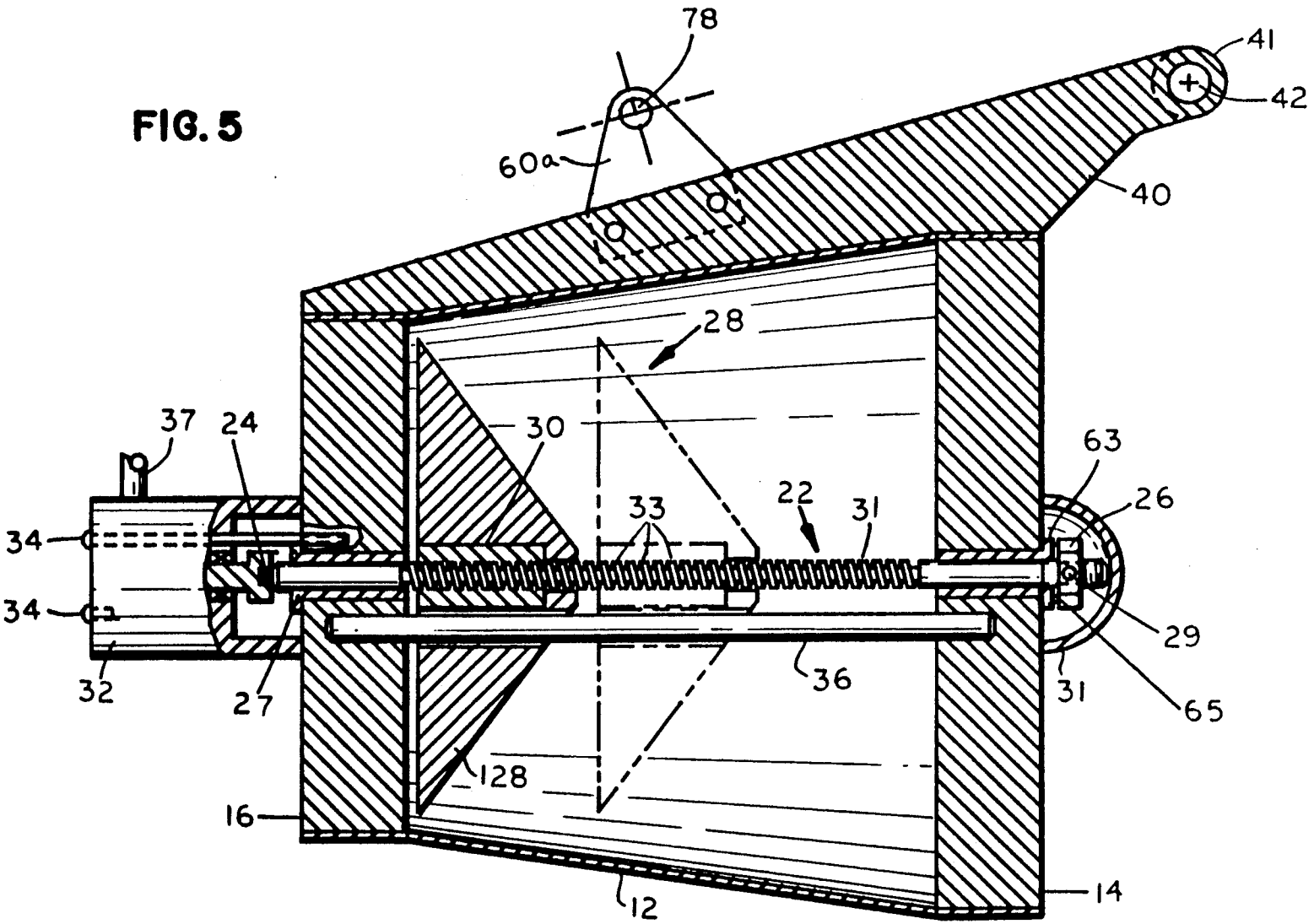
FIG. 5 is a partial cross-sectional view of the apparatus taken along lines 5—5 of FIG. 4.

Referring next to FIGS. 4 and 5, first end 14 is generally circular in cross-section and includes forward or first opening 18. In the preferred embodiment, the opening 18 is approximately 13½ inches in diameter to correspond with use of a 13 inch propeller. It should be understood that the size of the opening will vary depending on the size of the propeller and motor. In the preferred embodiment, the opening 18 is divided into four sections by a plurality of veins 19. It should be understood that the number of veins utilized may vary. For example, three veins which divide the opening into the sections may be utilized. In the preferred embodiment, the veins 19 are connected at hub 21 proximate the center of the forward opening 18 and are connected to the housing 12 at its perimeter. In the preferred embodiment, the veins 19 and hub 21 form an integral unit which is suitably fastened to the interior of the housing 12.

Figure 6:
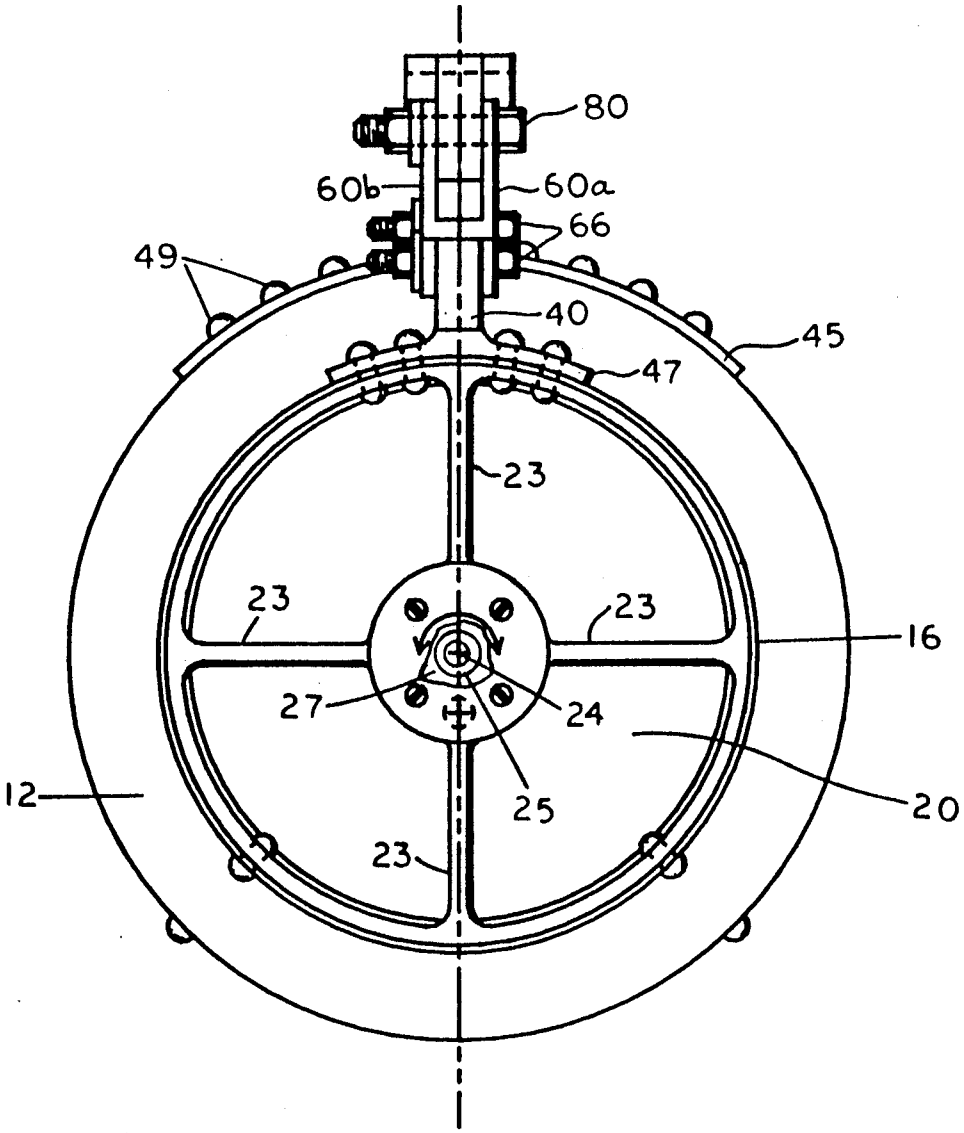
FIG. 6 is a rear view of the apparatus of FIG. 1.

Referring now to FIGS. 5 and 6, the second end 16 of housing 12 is also generally circular in cross-section and includes aft or second opening 20. In the preferred embodiment, the aft opening 20 is approximately 10 inches in diameter. The opening 20 will vary according to the size of forward opening 18. The aft opening 20 is divided into four sections in the preferred embodiment by a plurality of veins 23. As noted above, the number of veins utilized may vary. The veins 23 are connected at hub 25 proximate the center of the aft opening 20 and are connected to the housing 12 at its perimeter. In the preferred embodiment, the veins 23 and hub 25 form an integral unit which is suitably fastened to the interior of the housing 12.

Those skilled in the art will appreciate that veins 19 and 23 not only support screw assembly 22 (described below), but also aid in precluding submerged objects, and other flotsam, from entering housing 12 and potentially damaging or lodging within housing 12. Therefore, preferably veins 19 and 23 are spaced in accordance with structural considerations as well as the foregoing protective considerations. A screen (not shown) may also be utilized at opening 18 to prevent weeds or other objects from entering housing 12. By reversing the direction of the propeller, weeds will be removed from the device 10.

Still referring to FIG. 5, screw assembly 22 extends through the interior of the housing 12. The screw assembly 22 is connected to the housing 12 at first and second ends 14 and 16 in the preferred embodiment. Preferably, the screw assembly 22 includes an elongate member 31 having threads 33. A bushing 27 and screw 24 are arranged to connect the screw assembly 22 to second end 16 and a bushing 63, screw 65, pin 29 and nut 26 arrangement connect the screw assembly 22 to first end 14. It should be understood that any suitable means of retention will suffice. The screw assembly 22 and the housing/entrainment member 12 are generally axially aligned in the preferred embodiment.

As shown in FIG. 4, the bushing 63, pin 29, nut 26 and screw 65 are cooperatively connected to hub 21. The veins 19 support the screw assembly 22 in axial alignment with the entrainment member 12. Additionally, a cover 31 covers and protects the bushing 63, screw 65, pin 29, nut 26 and hub 21. The cover 31 preferably is constructed aerodynamically such that fluid flow moving past the cover 31 may be laminar around and in the device 10. Likewise, as shown in FIG. 6, bushing 27 and screw 24 connect the opposite end of the screw assembly 22 to the second end 16 of the housing 12 at hub 25. Veins 23 support the assembly 22 in axial alignment with the entrainment member 12.

Referring once again to FIG. 5, a regulating assembly 28 is illustrated in an aft position. Regulating assembly 28 includes screw assembly 22, cone member 128, nut 30, stepper motor 32, and guide 36. Cone member 128 is generally cone-shaped with the apex of the cone facing the first end 14 of the entrainment member 12. Cone member 128 has a hole formed therein, the hole running from the apex of the cone to the center of the cone base. Screw assembly 22 is preferably inserted through the hole. Nut 30 which is located within the hole operatively cooperates with the threads 33 of the screw assembly 22.

Stepper motor 32 is connected to the housing 12. Screws 34 are utilized in the preferred embodiment as fastening devices, but any suitable connecting means will suffice. The motor 32 is operatively connected to the screw assembly 22 either directly as in the preferred embodiment, or may alternatively be connected via gears (not shown) or the like. The motor 32 is preferably an electric motor having a power supply, such as a 12 volt d.c. battery (not shown), connected to the motor 32 by means of a connector 37. The stepper motor 32 drives the screw assembly 22 which cooperatively interfaces with the nut 30 of the regulating assembly 28, thereby moving the cone member 128 forward or aft. A guide 36 is connected to the housing 12 at first and second ends 14 and 16. The guide 36 is connected to hubs 21 and 25 by means of preformed slots where the guide 36 is received within the slots. It should be understood that any other means for retaining guide 36 will suffice. The guide 36 passes through the cone member 128, via a second hole formed therethrough as shown in FIG. 5, to prevent the cone member 128 from rotating about its axis as the screw assembly 22 is rotated. Those skilled in the art will appreciate that any other means for preventing axial rotation may be utilized.

Additionally, those skilled in the art will recognize that cone member 128 may also be moved without the aid of a stepper motor. For example, the cone member 128 may be moved manually by the user to the desired position by rotation of the screw with suitable means.

Returning to FIGS. 1 and 3, a plate 40 is shown connected to the housing 12 of the preferred embodiment. The plate 40 includes fastening strips 45 and 47 which are fastened to the housing 12 by rivets 49, although any other suitable fastening means may be utilized. The strips 45 and 47 are shaped to conform with the housing 12 for a secure connection. The plate 40 is made of a marine grade aluminum in the preferred embodiment. It should be understood that any other suitable material may be utilized. The plate 40 includes a connector member 41 having an aperture 42 (best seen in FIG. 5).

A hinge plate 44 is connected to plate 40 by a nut and bolt arrangement 46 through aperture 42 of member 41. The hinge plate 44 has a generally U-shaped base 51 cooperatively connected to sidewalls 53 and 55. The sidewalls 53 and 55 are oriented generally normal to the base 51 and include apertures 57, 59, 63 and 65. The apertures 57 and 59 are axially aligned with one another, and the apertures 63 and 65 are axially aligned with one another, such that bolts may be inserted through the apertures forming axial pairs.

The hinge plate 44 is connected to an inboard or outboard motor 13 at the cavitation or anti-ventilation plate 48 by nut and bolt arrangements 50. Plate 40 is hingedly attached to hinge plate 44 via connector nut 150 and bolt 151. The nut and bolt arrangements 50 connect the base 51 of the hinge plate 44 to the motor 13. The connector bolt 151 slideably engages the sidewalls 53 and 55 through the apertures 57 and 59. The connector member 41 is positioned between the sidewalls 53 and 55. The bolt 151 slideably engages aperture 42 such that the apertures 42, 57 and 59 are axially aligned. Spacers 61 are positioned between connector member 41 from each of the sidewalls 53 and 55. In this manner, the connector member 41 and thus, the housing 12 are held between the sidewalls 53 and 55 at the desired centered position. In the preferred embodiment, the connection of plates 44, 40 and 48 position the housing 12 aft of the motor 13 in alignment with the rotational axis of propeller 52.

Figure 2:
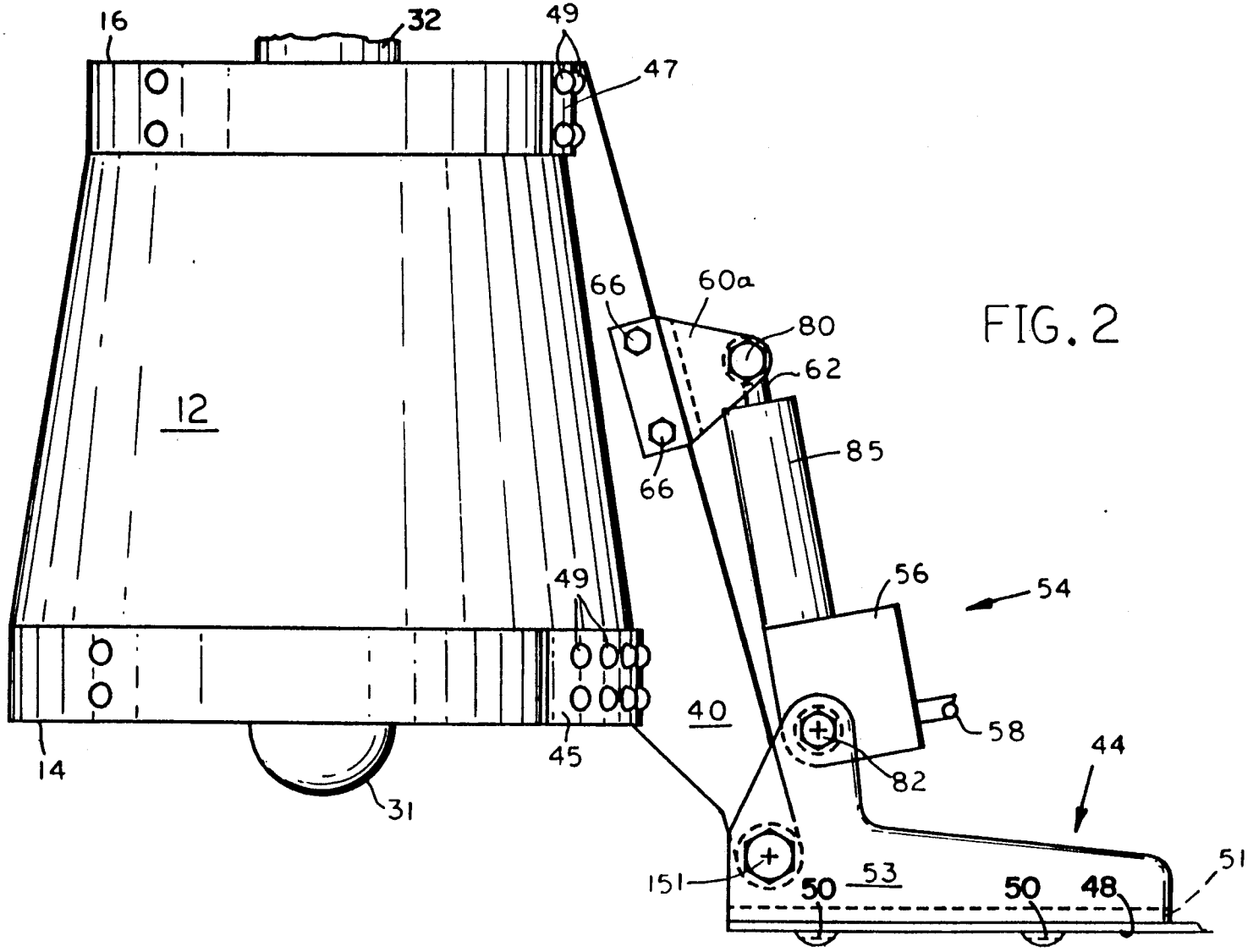
FIG. 2 is a side elevational view of the apparatus shown in a retracted position connected to the anti-ventilation plate of a boat motor.
Figure 3:
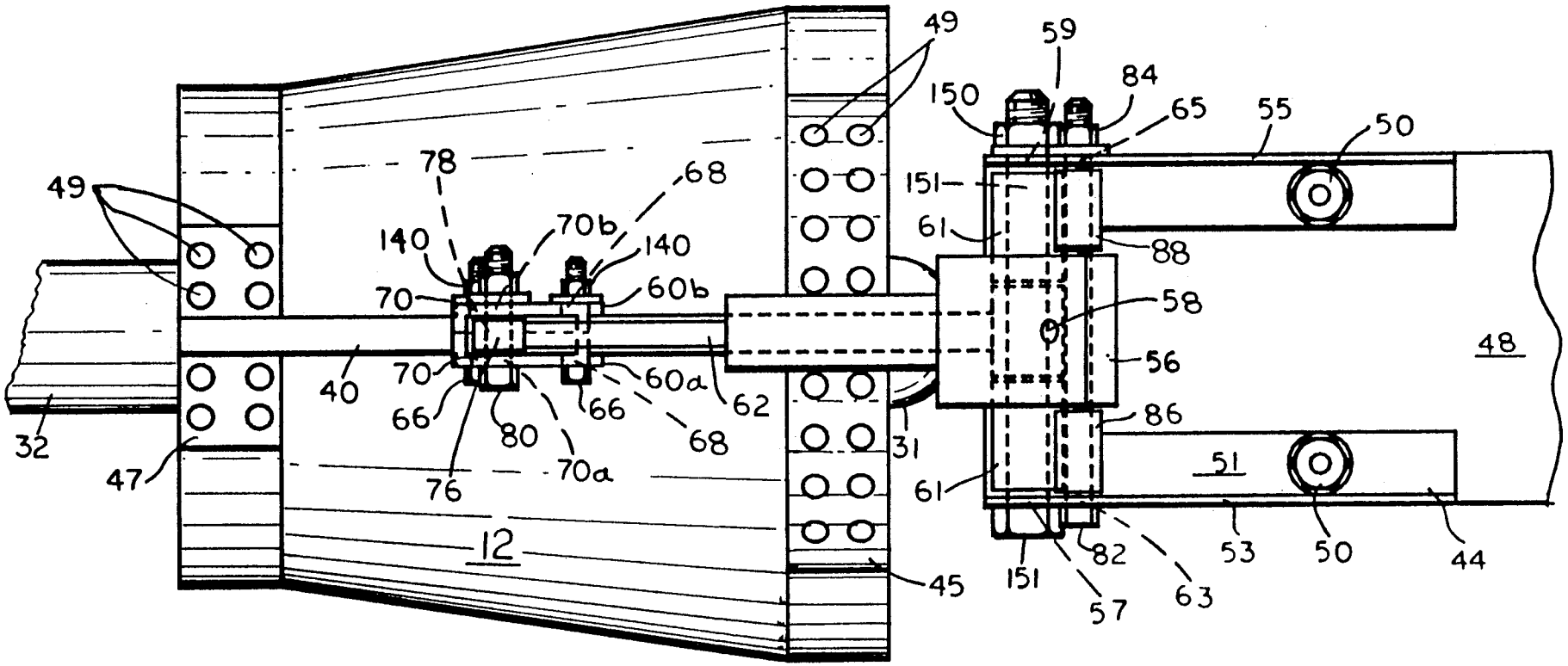
FIG. 3 is top view of the apparatus shown in an operating position connected to an anti-ventilation plate of a boat motor.

Still referring to FIGS. 1, 2 and 3, a retraction device 54 is illustrated connected to plate 40 and hinge plate 44. The retraction device 54 includes a retract/extend motor assembly 56, connector 58, power source 74, rod 62 and a pair of brackets **60*a* and 60*b* and brace 61. The brackets 60*a* and 60*b* include apertures 68*a* and 68*b*, 70*a* and 70*b*, and 72*a* and 72*b* respectively and are generally triangular in the preferred embodiment. Brace 61 is connected by standard means to brackets 60*a* and 60*b* to insure a strong connection. Those skilled in the art will recognize that brackets 60*a* and 60*b* and brace 61 may be formed as an integral unit. Brackets 60*a* and 60*b* are cooperatively connected to plate 40 by a pair of nuts 140 and bolts 66 arranged in apertures 68 and 70 (best seen in FIGS. 1 and 3). The rod 62 includes a rod connector 76 having an aperture 78. The rod 62 is connected to bracket 60*a* and 60*b* at aperture 78. A bolt 80 is inserted through apertures 70*a* and 70*b* of bracket 60*a* and 60*b*, as well as through aperture 78 of rod connector 76. The rod connector 76 is positioned between bracket 60*a* and 60*b*** in the preferred embodiment.

The retract/extend motor assembly 56 is connected to the hinge plate 44 by bolt 82. The bolt 82 extends through aperture 63, assembly 56 and aperture 65 as illustrated in FIG. 3. The assembly 56 is proximate the center of sidewall 53 and 55 in the preferred embodiment. A nut 84 secures the arrangement. Spacers 86 and 88 ensure that the assembly 56 remains relatively centered between the walls 53 and 55. It should be understood that any means to connect the retraction device 54 to the housing 12 may be utilized within the spirit of this invention.

The brackets **60*a* and 60*b* are connected to the rod 62 of the device 54. Actuation of the retraction motor assembly 56 causes the rod 62 to slideably move within the ball screw actuated linear actuator 85 of motor assembly 56, in a well known manner thereby causing the upward or downward movement of the housing 12. Therefore, the housing 12 may be moved between an operative position axially aft of propeller 52 as shown in FIG. 1 or retracted from that position, as illustrated in FIG. 2, to an inoperative position. The power source 74 is electric in the preferred embodiment and, as will be described in more detail below, enables the movement of the housing 12 about the pivot point 46. Those skilled in the art will recognize that a hydraulic cylinder arrangement may also be utilized with the retraction motor assembly 56. The operation may also be done manually. A load sensor (not shown) may also be included in the retract assembly 56 and control 92** described hereinafter to ensure retraction when the load is excessive.

It will be apparent to those skilled in the art that although numerous bolts are illustrated in the accompanying figures, no effort has been made to correlate each and every bolt to those illustrated. Those skilled in the art will recognize that other suitable fastening devices, weld, rivets, etc., might similarly be used in such an apparatus 10 as described herein.

Next, turning to FIG. **7*a*, there is illustrated a block diagram of the functional electrical elements of a preferred embodiment of the present invention. Control panel 92 is illustrated as being connected to power source 74. Limit switches 93 and 94 are also connected at the control panel 92. The limit switch 93 insures that the travel of the cone member 128 within housing 12 does not exceed certain predetermined limits. Limit switch 94 insures that certain predetermined limits are not exceeded when raising the device 12 from its operative position to its inoperative position. Finally, extend/retract motor 56 is connected at control panel 92 to the proper switch 90, limit switch 94, and power source 74, while stepper motor 32 is connected at control panel 92 to switch 98, limit switches 93 and power source 74**.

It will be appreciated by those skilled in the art that although it is not specifically detailed in FIG. **7*a***, it will be understood that the various functional elements are to be properly connected to appropriate bias and reference supplies so as to operate in their intended manner.

In operation, the apparatus 10 is first moved into an operating position aft of propeller 52 of motor 13. Therefore, the retraction device 54 is actuated by the user by means of two-way switch 90 on control panel 92. Panel 92 may be ideally located in the users boat near other controls utilized by a user. Switch 90 is operatively connected to actuate the retraction motor assembly 56 through connector 58. The motor 56 drives the actuator 85 such that rod 62 extends from the assembly 56 and the assembly rotates about pivot point 42. As the rod 62 extends and the assembly rotates, the housing 12 is rotated about pivot point 42, thereby lowering the housing 12 into operative position aft of the propeller 52. When the actuator 85 is at the end of its stroke, the limit switch 94 is activated to stop the motion of the device. An indicator light 100, located at the panel 92, indicates that the housing 12 is in the proper position.

Once the housing 12 is in its operative position, the stepper motor 32 may be actuated to regulate the flow of water through the entrainment 12. Switch 98 is operatively connected to the stepper motor 32 at control panel 92. The switch 98 may be toggled between two active states from a neutral middle position. The first active state (i.e., toward the "increase" indicator) enables forward movement of the cone member 128 within housing 12, thereby allowing a greater volume of water to move through the apparatus 10. The second active state of the switch 98 (i.e., toward the "decrease" indicator) reverses direction of the cone member 128 (i.e., moves the cone member 128 aft) and, therefore, decreases the volume of water through the entrainment 12. Indicator lights 200 respond to the switch 98 and display the movement of the cone member 128 and therefore, an increase or decrease in speed of the craft.

Those skilled in the art will appreciate that the flow of water is influenced by the diameter of the cone member base relative to the taper of entrainment member 12. For example, a longer gentler taper will provide a greater degree of choice of fluid flow volume. Additionally, those skilled in the art will recognize that the screw assembly 22 thread pitch, and motor 13 speed will also affect the speed selection process.

More specifically, when the control switch 98 activates the stepper motor 32, the worm gear or screw assembly 22 is rotated in the counter clockwise direction. The cone member 128 moves from second end 16 of the housing 12 to first end 14. As noted above, the positioning of the cone member 128 determines the fluid flow through the entrainment member 12, and accordingly, the speed of the boat. The closer the cone member 127 is moved toward first end 14, the greater the area between the housing 12 and the base of cone member 128.

As will be apparent to those skilled in the art, when the craft is in operation, the thrust from propeller 52 is directed into entrainment 12. The thrust tends to move through the entrainment 12. The flow of thrust is forced through the open area controlled by the regulator assembly 28. The jet flow passes around the cone member 128, through the controlled, variable opening and exits opening 20. The controlled rate of flow through the device 10 controls the thrust providing a minimal thrust thereby controlling the speed of the boat. Therefore, the user is allowed to troll with a large horsepower motor. Limit switch 93, described above, is connected to the stepper motor 32 to stop motion when the cone member 128 reaches the end of the housing 12. In the preferred embodiment, limit switch 93 stops motion of the regulator prior to reaching the end of the housing 12. Therefore, there will always be an opening between the housing 12 and cone 128.

To decrease speed of the boat, the switch 98 is moved toward the "decrease" position. The switch activates the stepper motor 32 in the opposite direction. The motor 32 moves the screw assembly 22 in a clockwise direction (as viewed from the aft) which moves the cone member 128 from first end 14 toward second end 16. In this manner, there are limitless positions to control the speed of the user's craft. The placement of the cone member 128 and the control of the outboard or inboard motor throttle position allow the user an endless choice of speeds and/or thrust to provide proper presentation of bait in all conditions. It should be understood that any other suitable means within the entrainment 12 may be utilized to control the flow of fluid therein. For example, a series of fins or a cone of changing diameter for influencing the flow may be utilized and is contemplated within the broad spirit of the present invention.

When the user wishes to retract the assembly 10, switch 90 is activated in the opposite direction of retract and the motor 56 reverses direction which raises the housing 12. Indicator light 102 on control panel 92 indicates the retract position of the motor assembly 56.

Figure 7A:
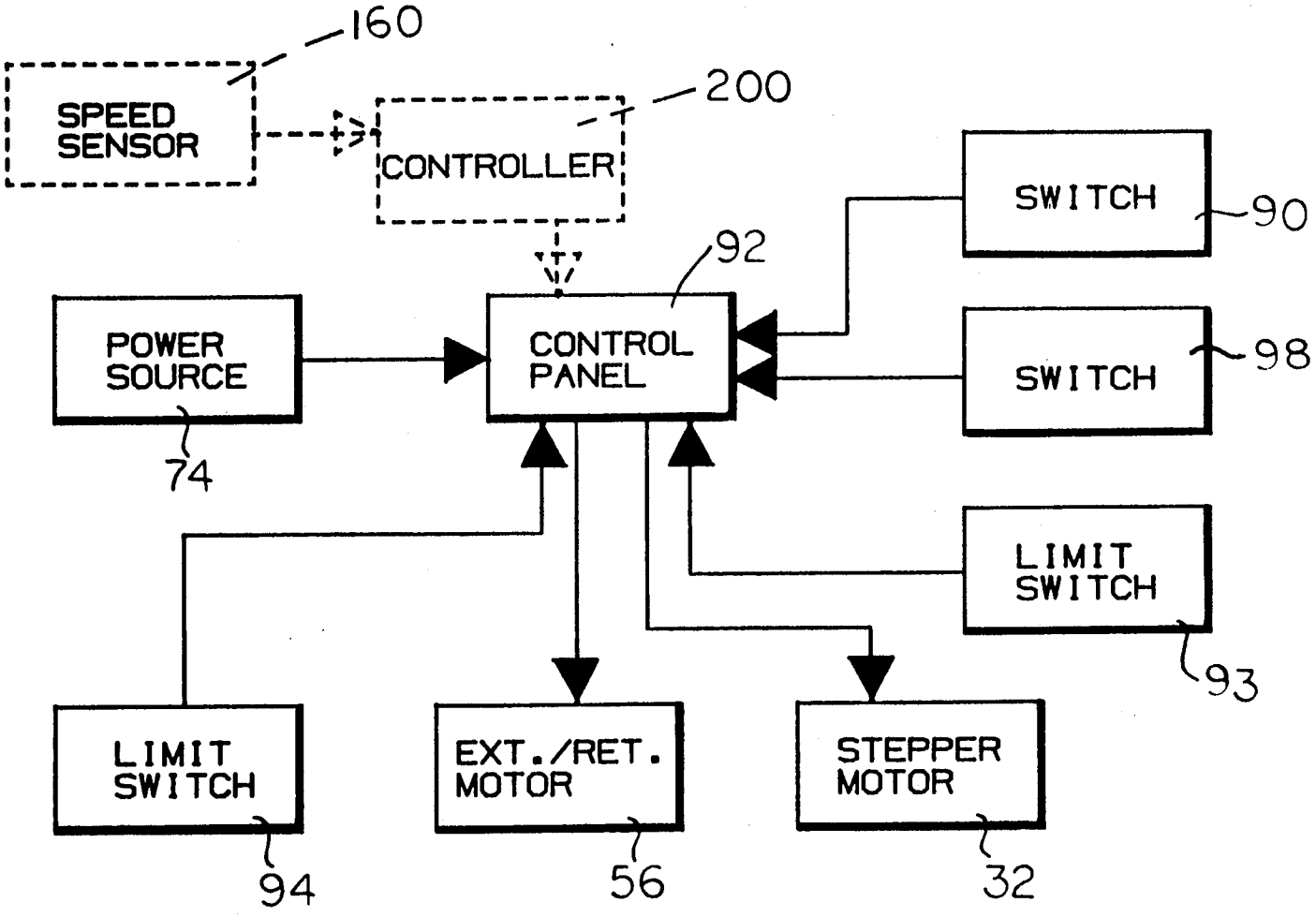
FIG. 7*a* is a block diagram illustrating the electrical functional blocks of the apparatus of FIG. 1.
Figure 7B:
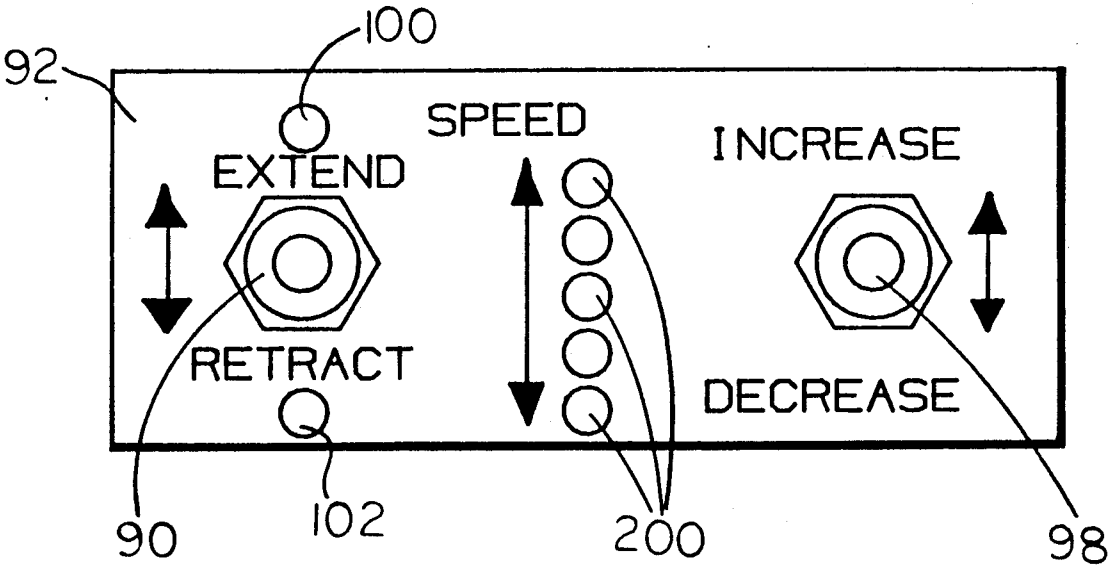
FIG. 7*b* is a top view of a preferred control panel for the apparatus of FIG. 1 for the controller functional block of FIG. 7*a*.

An alternative embodiment may include sensors 160, illustrated in FIG. 7*a* which monitor the speed of the watercraft. By this means, the, user could choose a desired speed and the controller (not shown) would respond in conjunction with the sensors 160 and stepper motor 32 to maintain the desired speed. The controller (not shown) monitors the output of the sensors 160 and actuates the motor 32 as needed to maintain the desired speed.

ALTERNATIVE EMBODIMENT

Figure 8:
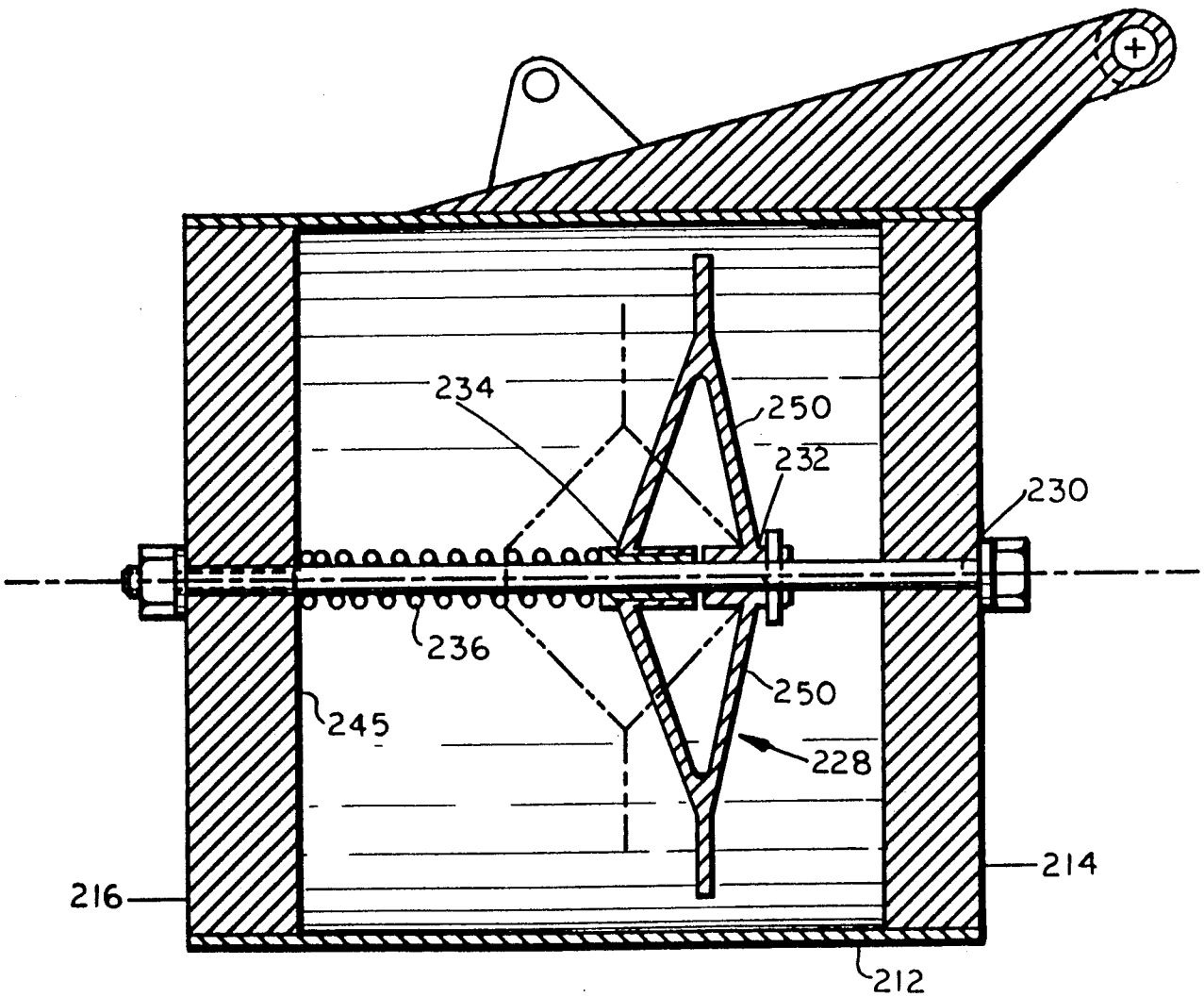
FIG. 8 is a partial cross-sectional view of an alternative embodiment of the apparatus of FIG. 1.

Another alternative embodiment of the invention is shown in FIG. 8. This embodiment includes an elastic, deformable regulator member 228. The member 228 is generally disk shaped and is operatively connected to a rod 230. The rod 230 is attached to the entrainment 212 by conventional fastening means at first end 214 and exit end 216. The entrainment 212 is generally cylindrical in shape in this embodiment. This shape provides for easy manufacturing. The rod 230 is axially aligned within the entrainment 212 in this alternative embodiment. The member 228 has a first end 232 and a second end 234 where the regulator 228 is fixed at first end 232 to the rod 230 by conventional means. Second end 234 is operatively connected to the rod 230 by means of spring 236. Rod 230 receives spring 236 and is positioned between second end 234 of the regulator 228 and an end wall 245 of the entrainment 212.

In operation, the thrust of the motor enters housing 212 at first end 214. The thrust forces the wall 250 of the regulator 228 to move toward the exit end 216 of the entrainment 212. This forces causes the spring 236 to move between its first resting position shown in FIG. 8 and a second fully compressed position shown in phantom. As shown in FIG. 8 in dotted lines, when the spring 236 is compressed, the diameter of the regulator 228 is decreased therefore, increasing the opening for water to travel through the entrainment 212. Therefore, the amount of water which is allowed to exit the entrainment is controlled by the thrust of the boat motor. A greater thrust and thus a greater force on the wall 250 of the regulator 228 will cause the spring to fully compress and allow a greater volume of water to pass through the entrainment 212. When the spring 236 is in its resting position, the water which is allowed to flow through the entrainment 212 is decreased.

It should be understood that the alternative embodiment described above may be used in conjunction with the controls, retraction and other aspects of the invention described above. Further, the alternative embodiment may be designed to move automatically or manually, as above, rather than solely by the thrust action.

The aspects of the embodiment will not be described further, as one skilled in the art will understand suitable adjustments and connections are within the broad scope of the present invention.

It should be understood that even though numerous characteristics and advantages of the present invention have been set forth in the foregoing description, together with details of the structure and function of the invention, the disclosure is illustrative only and changes may be made in detail, especially in matters of the mounting, use of fastening devices and means of moving cone member 128. Other modifications and alterations are well within the knowledge of those skilled in the art and are to be included within the broad general meaning of the terms in which the appended claims are expressed.

What is claimed is:

1. An apparatus for controlling a thrust created by a propeller of an aquatic motor, comprising:

(a) means for entraining the thrust connected to the motor, said entrainment means having an entrance and an exit for flow therethrough; and (b) means for regulating the thrust flow through said entrainment means, said regulating means connected to said entrainment means, wherein said regulating means is moved forward or aft within said entrainment means to regulate the thrust flow therein and wherein said regulating means is generally cone shaped wherein the apex is proximate said propeller.

2. The apparatus of claim 1 wherein said entrainment means is generally frusto-conical in shape, having first and second ends corresponding to said entrance and exit, the end of greater diameter being proximate said propeller.

3. The apparatus of claim 1 wherein said entrainment means is axially aligned with the axis of the propeller.

4. The apparatus of claim 1 wherein said regulating means is axially aligned within said entrainment means.

5. The apparatus of claim 1 including retracting means for positioning and retracting said entrainment means.

6. The apparatus of claim 5 wherein said retracting means includes a motor and control means for positioning and retracting said entrainment means.

7. The apparatus of claim 1 wherein said regulating means forward or aft movement within said entrainment means increases or decreases the rate at which fluid may flow through said entrainment means thereby regulating the thrust flow.

8. The apparatus of claim 7 further including means for controlling the movement of said regulating means.

9. An apparatus for controlling a thrust created by a propeller of an aquatic motor, comprising:

(a) means for entraining the thrust, said entrainment means cooperatively connected to the motor, said entrainment means having an entrance and an exit for flow therethrough; and (b) means for regulating the thrust flow through said entrainment means, said regulating means connected to said entrainment means, wherein said regulating means includes a deformable member, said deformable member located centrally within said entrainment means, whereby the thrust flows around said deformable member.

10. The apparatus of claim 9 wherein said regulating means deforms by means of the thrust fluid flow thereby increasing or decreasing the rate at which fluid may flow through said entrainment means.

11. The apparatus of claim 9 wherein said regulating means is axially aligned with the rotational axis of the propeller and said entrainment means.

12. The apparatus of claim 9 including retracting means for positioning and retracting said entrainment means.

13. An apparatus for controlling the speed of a boat motor, the motor having a propeller for creating a thrust, comprising:

(a) means for entraining the thrust connected to the motor aft of the propeller; and (b) means for regulating the thrust flow through said entrainment means connected therein, wherein said regulating means is generally cone shaped and wherein the apex is proximate said propeller.

14. The apparatus of claim 13 wherein said entrainment means is generally frusto-conical in shape having first and second ends having openings, the end of greater diameter proximate said propeller.

15. The apparatus of claim 14 wherein said entrainment means is axially aligned with the rotational axis of the propeller.

16. An apparatus for controlling the speed of a boat, comprising:

(a) a motor having a propeller for creating a thrust to propel the boat;

(b) means for entraining the thrust cooperatively connected to said motor aft of said propeller, at least a portion of the thrust flowing through said entraining means; and (c) means for controlling the portion of thrust flowing through said entraining means, said controlling means connected to said entrainment means, wherein said controlling means includes a deformable member;

whereby said controlling means regulates the thrust flowing through said entrainment means by forward or aft movement of said controlling means within said entrainment means.

17. A method for controlling a thrust of an aquatic motor, comprising the steps of:

(a) entraining the thrust in an entrainment member positioned aft of the aquatic motor; and (b) regulating the thrust through said entrainment member, wherein regulating includes deforming a deformable member located centrally within said entrainment member and wherein the thrust deforms said deformable member thereby increasing or decreasing the rate at which the thrust is entrained through said entrainment member.

18. An apparatus for controlling a thrust created by a propeller of an aquatic motor, comprising:

(a) means for entraining the thrust connected to the motor, said entrainment means having an entrance and an exit for flow therethrough; and (b) means for regulating the thrust flow through said entrainment means, said regulating means connected to said entrainment means, wherein said regulating means includes a deformable member, wherein said regulating means deforms by means of the thrust fluid flow, thereby increasing or decreasing the rate at which fluid may flow through said entrainment means.

19. An apparatus for controlling a thrust created by a propeller of an aquatic motor, comprising:

(a) means for entraining the thrust connected to the motor, said entrainment means having an entrance and an exit for flow therethrough;

(b) means for regulating the thrust flow through said entrainment means, said regulating means connected to said entrainment means, wherein said regulating means includes a deformable member; and (c) retracting means for positioning and retracting said entrainment means.

20. The apparatus as recited in claim 1, wherein said generally cone shaped regulating means includes a continuous slanting surface.

* * * * *